US009309082B2

(12) United States Patent
Sussmeier et al.

(10) Patent No.: US 9,309,082 B2
(45) Date of Patent: Apr. 12, 2016

(54) METHOD AND APPARATUS FOR ENHANCED CUTTER THROUGHPUT USING AN EXIT MOTION PROFILE

(75) Inventors: John W. Sussmeier, Cold Springs, NY (US); Boris Rozenfeld, New Milford, CT (US); Arthur H. DePoi, Brookfield, CT (US)

(73) Assignee: Pitney Bowes Inc., Stamford, CT (US)

( * ) Notice: Subject to any disclaimer, the term of this patent is extended or adjusted under 35 U.S.C. 154(b) by 1147 days.

(21) Appl. No.: 12/792,962

(22) Filed: Jun. 3, 2010

(65) Prior Publication Data

US 2010/0236365 A1 Sep. 23, 2010

Related U.S. Application Data

(63) Continuation of application No. 11/607,489, filed on Dec. 1, 2006, now Pat. No. 7,752,948.

(51) Int. Cl.
*B65H 29/12* (2006.01)
*B65H 35/04* (2006.01)

(52) U.S. Cl.
CPC ..... *B65H 29/12* (2013.01); *B65H 35/04* (2013.01); *B65H 2301/4451* (2013.01); *B65H 2513/20* (2013.01); *B65H 2601/2525* (2013.01); *Y10T 83/0462* (2015.04); *Y10T 83/202* (2015.04); *Y10T 83/2094* (2015.04)

(58) Field of Classification Search
CPC ..... B65H 29/12; B65H 35/04; B65H 2301/4451; B65H 2513/20; B65H 2601/2525; Y10T 83/0462; Y10T 83/202
USPC ..... 83/203, 26, 27, 110, 202; 427/209
See application file for complete search history.

(56) References Cited

U.S. PATENT DOCUMENTS

| | | | | |
|---|---|---|---|---|
| 1,400,777 | A | | 12/1921 | Spiess |
| 3,025,740 | A | | 3/1962 | Morris |
| 3,279,290 | A | | 10/1966 | Stemmler |
| 3,665,796 | A | | 5/1972 | Witte |
| 3,902,954 | A | * | 9/1975 | Lotto ..... 156/510 |
| 4,144,780 | A | * | 3/1979 | Bromer et al. ..... 83/76.7 |
| 4,149,484 | A | | 4/1979 | Koch |
| 4,184,392 | A | | 1/1980 | Wood |
| 4,880,371 | A | | 11/1989 | Spinelli et al. |
| 5,014,582 | A | * | 5/1991 | Teik ..... 83/24 |
| 5,024,128 | A | * | 6/1991 | Campbell, Jr. ..... 83/26 |
| 5,090,683 | A | | 2/1992 | Kamath et al. |
| 5,107,734 | A | | 4/1992 | Armbruster |

(Continued)

FOREIGN PATENT DOCUMENTS

| | | | |
|---|---|---|---|
| DE | 102006060289 | A1 | 6/2007 |
| EP | 1481817 | A2 | 12/2004 |

*Primary Examiner* — Sean Michalski
(74) *Attorney, Agent, or Firm* — Michael J. Cummings; Charles R. Malandra, Jr.; Steven J. Shapiro

(57) ABSTRACT

A method and apparatus are for decelerating a sheet of paper in a paper-cutting system. The sheet of paper is cut using a cutter, and the sheet is then accepted into a take-away nip. The take-away nip is operated at an initial rate in order to move the sheet of paper away from the cutter at an initial speed. The take-away nip is then operated at a rate decreasing to a final rate, in order to decelerate the sheet of paper to a final speed by the time the sheet of paper exits the take-away nip. The take-away nip is subsequently operated at the initial rate again, prior to accepting another sheet of paper at the initial speed.

10 Claims, 8 Drawing Sheets

(56) References Cited

U.S. PATENT DOCUMENTS

| | | | | | |
|---|---|---|---|---|---|
| 5,175,691 | A | * | 12/1992 | Baker et al. | 700/220 |
| 5,251,554 | A | | 10/1993 | Eckert et al. | |
| 5,279,195 | A | | 1/1994 | Breton et al. | |
| 5,295,060 | A | | 3/1994 | Eckert et al. | |
| 5,308,435 | A | | 5/1994 | Ruggles et al. | |
| 5,331,576 | A | | 7/1994 | Eckert et al. | |
| 5,337,248 | A | | 8/1994 | Eckert et al. | |
| 5,337,660 | A | | 8/1994 | Eckert et al. | |
| 5,358,592 | A | * | 10/1994 | Fukuyama | 156/361 |
| 5,380,109 | A | | 1/1995 | Eckert et al. | |
| 5,415,089 | A | * | 5/1995 | Eckert et al. | 101/91 |
| 5,442,983 | A | | 8/1995 | D-Angelo et al. | |
| 5,613,675 | A | * | 3/1997 | Kruger et al. | 271/270 |
| 5,713,256 | A | * | 2/1998 | Keeny | 83/26 |
| 6,031,633 | A | * | 2/2000 | Andoh et al. | 358/412 |
| 6,299,730 | B1 | | 10/2001 | Broek et al. | |
| 6,364,305 | B1 | | 4/2002 | Sussmeier et al. | |
| 6,418,825 | B1 | * | 7/2002 | Hartmann | 83/110 |
| 6,474,885 | B2 | | 11/2002 | Kuzniarek et al. | |
| 6,570,354 | B1 | * | 5/2003 | Dobbertin et al. | 318/560 |
| 6,744,590 | B2 | | 6/2004 | Chu et al. | |
| 7,350,736 | B2 | | 4/2008 | Caamano et al. | |
| 2002/0084569 | A1 | | 7/2002 | Ifkovits et al. | |
| 2004/0062582 | A1 | * | 4/2004 | Dobbertin et al. | 399/394 |
| 2006/0000936 | A1 | * | 1/2006 | Caamano et al. | 242/390.9 |
| 2006/0191426 | A1 | | 8/2006 | Timmerman et al. | |
| 2006/0230201 | A1 | | 10/2006 | Fromherz et al. | |
| 2006/0239733 | A1 | | 10/2006 | Choi et al. | |
| 2008/0106025 | A1 | * | 5/2008 | Padros et al. | 270/52.09 |
| 2008/0306626 | A1 | * | 12/2008 | Elliot | 700/230 |

* cited by examiner

METHOD AND APPARATUS FOR ENHANCED CUTTER THROUGHPUT USING AN EXIT MOTION PROFILE

TECHNICAL FIELD

The present invention relates generally to paper cutting devices, and more particularly to a high speed inserter system, in which individual sheets are cut from a continuous web of printed materials for use in mass-production of mail pieces.

BACKGROUND OF THE INVENTION

Inserter systems, such as those applicable for use with the present invention, are mail processing machines typically used by organizations such as banks, insurance companies and utility companies for producing a large volume of specific mailings where the contents of each mail item are directed to a particular addressee.

In many respects, the typical inserter system resembles a manufacturing assembly line. Sheets and other raw materials (other sheets, enclosures, and envelopes) enter the inserter system as inputs. Then, a variety of modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

The input stages of a typical inserter system are depicted in FIG. 1*a*. Rolls or stacks of continuous printed documents, called a web, are provided at a web supply and fed into a web cutter where the continuous web is cut into individual sheets. In some inserter systems, the input stages of an inserter also include a right-angle turn (RAT) to allow the individual pages to change their moving direction before they are fed into the inserter, as shown in FIG. 1*b*. The present invention is primarily related to an inserter system having a RAT.

In general, web material is driven in move-and-pause cycles, wherein the web material is temporarily paused for a short period to allow the cutter to cut the material into cut sheets. Thus, in each cycle, the web must be accelerated and decelerated. FIG. 2 illustrates the input stages of an inserter system. As shown in FIG. 2, the web material 5 is driven continuously by a web driver 100 into a cutter module 200. The cutter module 200 has a cutter 210, usually in a form of a guillotine cutting blade, to cut the web material 5 crosswise into separate sheets 8.

FIG. 3 is a schematic representation of a web cutter for splitting a web into two side-by-side portions before separating the web into individual sheets. This arrangement utilizes a right-angle turn (RAT) 309. The web material 5 is split into two side-by-side portions by a cutting device 312. The cutting device 312 may be a stationary knife or a rotating cutting disc. After the web material 5 is split into two side-by-side portions, it is cut crosswise by the guillotine cutter 210 into pairs of sheets 321 and 322. The sheets 321 and 322 move side-by-side toward the right angle turn device 309 so that they can then move in tandem (or with some overlap) into an inserter system.

The high productivity arrangements currently in use, which provide high system throughput performance, will be limited for cut sheets with high aspect ratios (sheet length divided by sheet width). Such sheets must pass enter the inserter system more slowly, and therefore must pass through the right-angle turn (RAT) at a lower speed than cut sheets having higher aspect ratios. Because a cut sheet having a high aspect ratio must enter the RAT at a lower speed, a tip to tail crash at the exit of the cutting device 210 will occur. In other words, the tip of the paper web will collide with the tail of a cut sheet. On older equipment which processes all cut sheets at much slower rates, this problem does not exist.

SUMMARY OF THE INVENTION

The present invention overcomes the disadvantages of the prior art by introducing a non-constant velocity profile for cut sheets exiting the cutter, thereby eliminating tip to tail crashes. Without the non-constant velocity profile, the tip of the paper web will crash into the tail of a cut sheet, at the exit of the cutter. The motion profile effectively increases inter-sheet gaps.

The present invention is applicable to cut sheet applications that have high aspect ratios, and minimizes downstream velocities for reliable accumulation. The invention enables increased system throughput performance on customer applications even if high aspect ratios are involved.

The method, apparatus, and software product of the present can be used for accelerating and decelerating a sheet of paper in the paper-cutting system. A web of paper is cut using the cutter, when the paper is substantially stopped. This forms a tail end of the sheet of paper.

The leading end of the sheet of papare is then in a nip, and the nip is operated the nip so as to move the sheet of paper away from the cutter. The nip is then decelerated in order to slow the sheet of paper to a final speed, at least by the time the tail end of the sheet of paper exits the nip.

The final speed of the sheet of paper is low enough to meet requirements for downstream processing of the sheet of paper. The average speed of the sheet of paper, while it is secured in the nip, is greater than the final speed, and the average speed is large enough to avoid contact between the sheet of paper and the web. However, the average speed is small enough to prevent the leading end of the sheet of paper from contacting a downstream sheet. This operation of the nip is subsequently repeated, in order to move further sheets of paper away from the cutter.

The deceleration cause by the nip will be non-zero if and only if the sheet of paper has dimensions exceeding a threshold, and otherwise the sheet of paper will have a substantially constant velocity while being moved by the nip. Preferably, the threshold is a ratio of sheet length divided by sheet width, so that for long and narrow sheets the nip will decelerate the sheet of paper. The final speed, to which the sheet of paper is decelerated, will depend upon the ratio of sheet length divided by sheet width, so that the final speed is further reduced if the ratio is increased.

DETAILED DESCRIPTION OF AN EMBODIMENT OF THE INVENTION

An embodiment of the present invention will now be described. It is to be understood that this description is for purposes of illustration only, and is not meant to limit the scope of the claimed invention.

Figure 4:
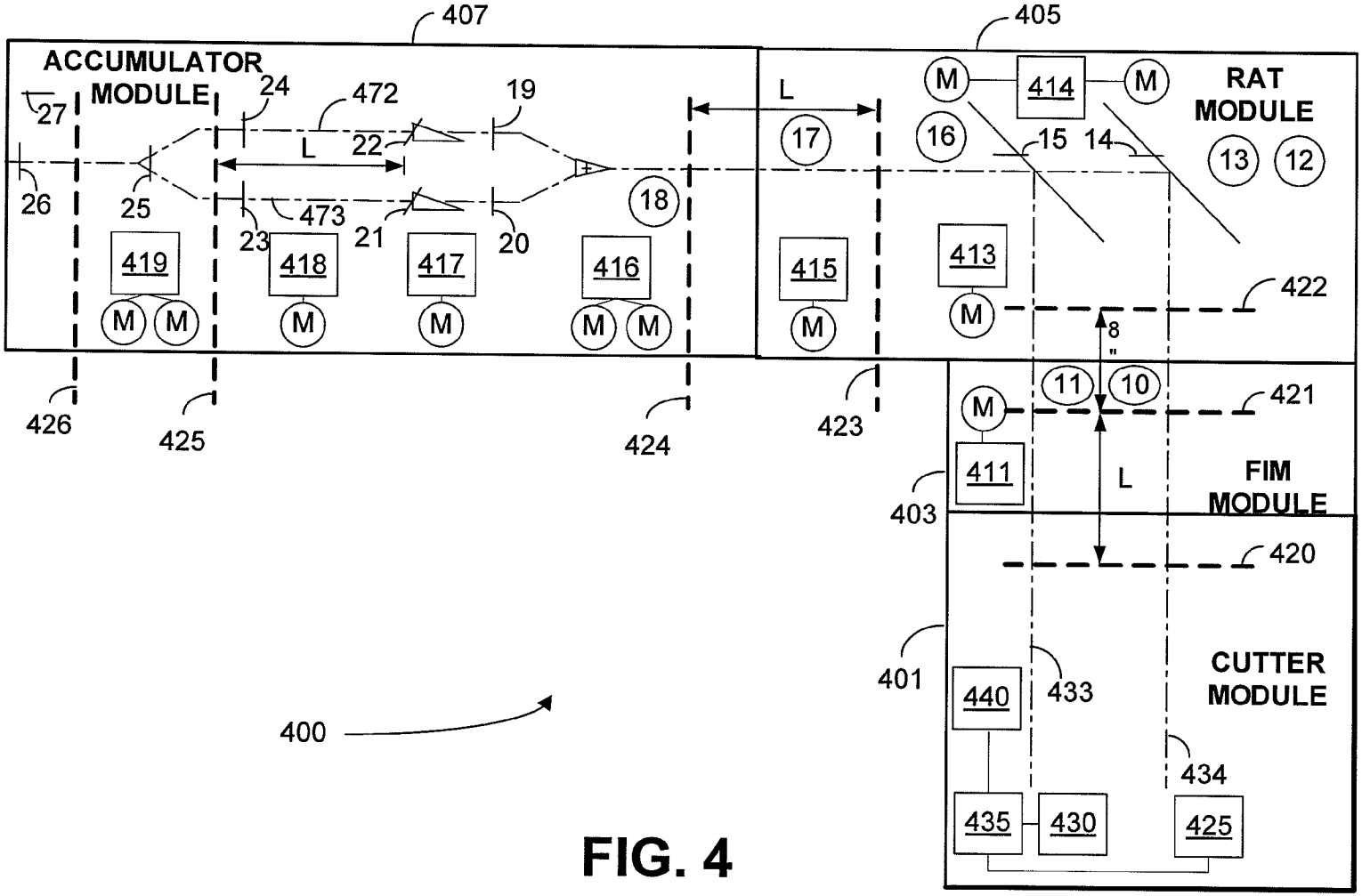
FIG. 4 is a schematic representation of four modules of an inserter system including a cutter module, feeder interface module (FIM), a right angle turn (RAT) module, and accumulator module.

FIG. 4 is a top view illustrating an architecture 400 that can provide an environment for the present invention. A cutter module 401 includes a cutter controller 440, operatively connected to cutter motor controller 435. The cutter motor controller controls two scan units 430 and 425, one for each of two paper paths 433 and 434 leading to the cutter. The paper is cut at the blade line 420.

A feeder interface module 403 exists at the output of the cutter module 401, in order to deliver sheets to a right angle turn module 405, which then merges the two paths of sheets into a single path. The sheets are then fed to an accumulator module 407. Thus, the architecture in FIG. 4 is divided into four modules: the cutter module 401, the FIM module 403, the RAT module 405, and the accumulator module 407. The latter three modules include a variety of servo motor controllers 411 thru 419 with accompanying motors (M), and a variety of sensors 10 thru 27 are distributed throughout the modules primarily in order to monitor the progress of sheets through the architecture 400.

Figure 1A:
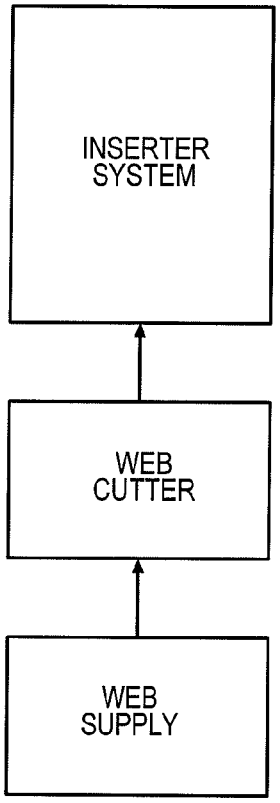
FIG. 1a ( PRIOR ART )
FIG. 1*a* is a block diagram showing the input stages of a typical inserter system.
Figure 1B:
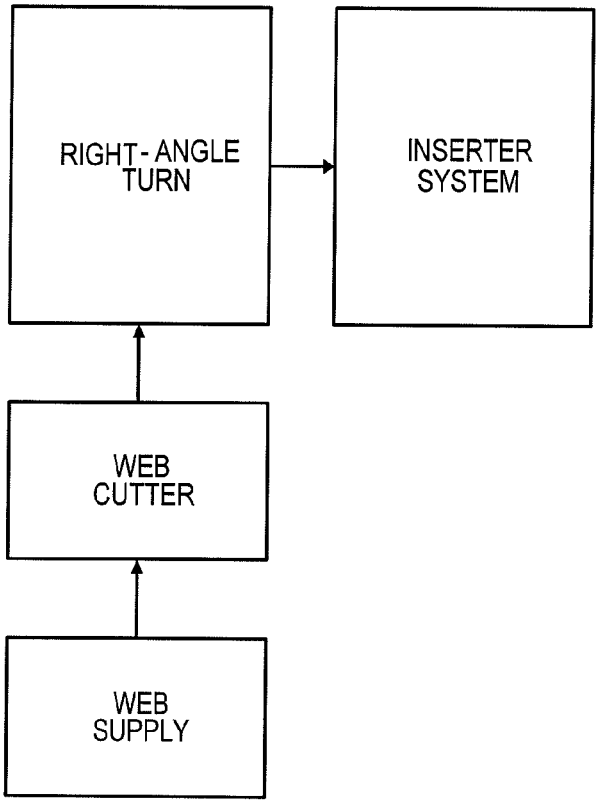
FIG. 1b ( PRIOR ART )
FIG. 1*b* is a block diagram showing the input stages of a typical inserter system including a right-angle turn.
Figure 2:
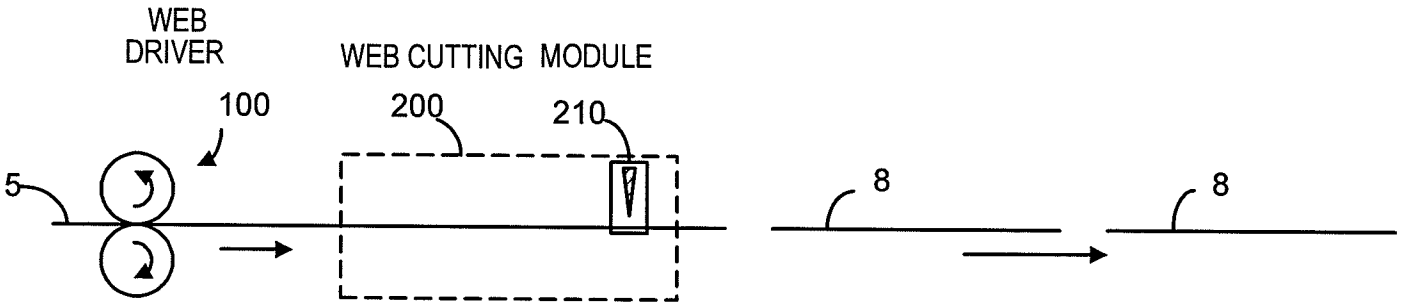
FIG. 2 ( PRIOR ART )
FIG. 2 is a side view of an inserter system including web cutting module.
Figure 3:
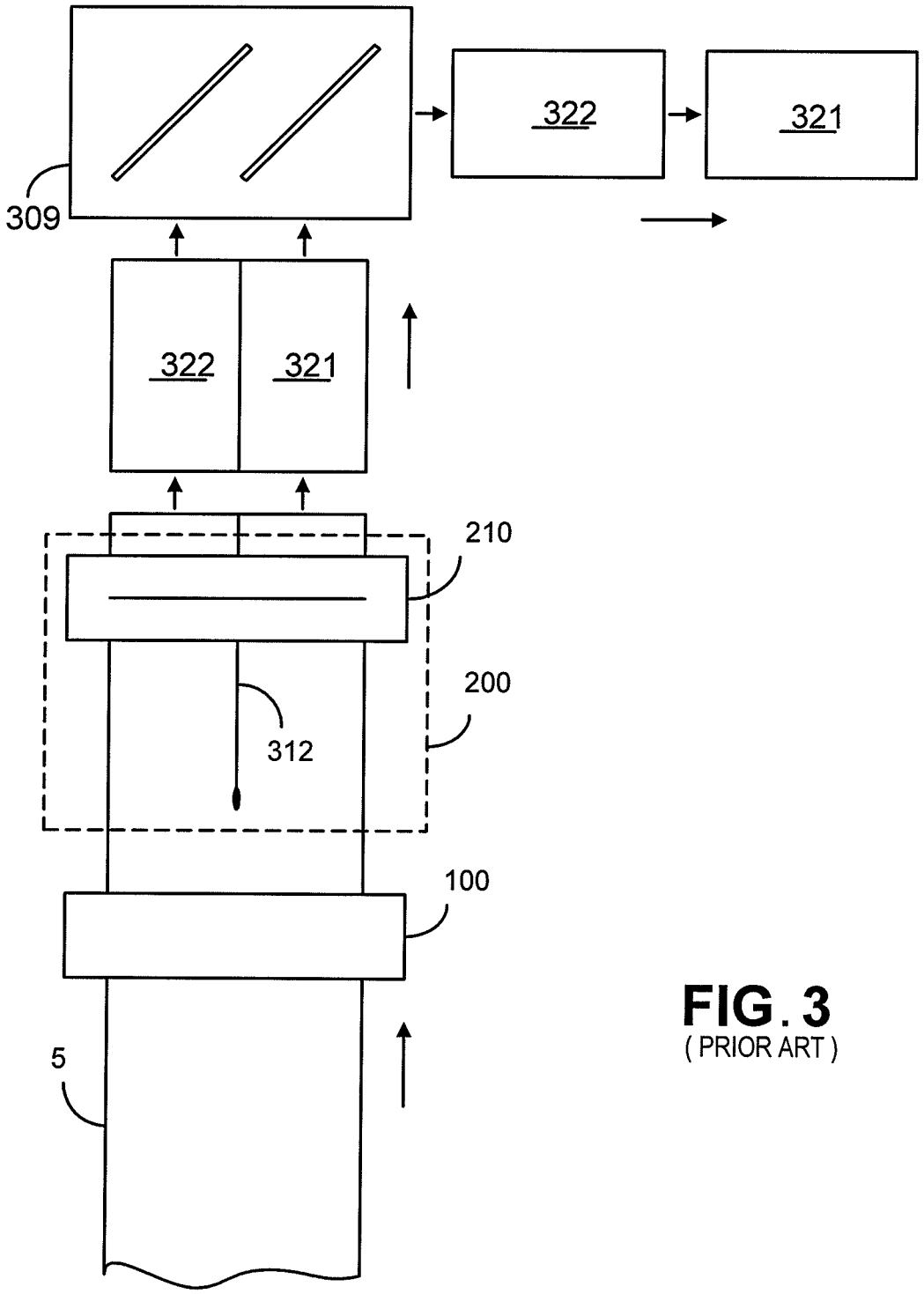
FIG. 3 ( PRIOR ART )
FIG. 3 is a schematic representation of a web cutter for splitting a web into two side-by-side portions and then separating the web into individual sheets.

Paper is cut in the cutter module at the blade line 420, and at least one sheet length (L) later there is a FIM nip line 421 that accepts each piece of paper and moves it forward toward a fixed RAT nip 422. The FIM nip line may be moveable in order to accommodate paper sheets of different lengths "L." Both the FIM nip and the subsequent nips may be configured similarly to the web driver 100 shown in FIG. 2. After passing through the right angle turn, the merged paper is propelled forward at an adjustable RAT exit nip line 423, which precedes by approximately one document length "L" a fixed high speed nip line 424.

In this embodiment of the invention, the speed of the paper web decreases gradually as the paper web moves into position to be cut by the cutter. It is therefore important for a sheet that has already been cut to stay ahead of the web.

In some existing FIM modules 403, the outer path 434 of a split drive operates at a higher velocity than the inner velocity. This is desired to maximize throughput performance, because the differential velocity increases the overlap between same cut sheet pairs that always belong to the same collation, thereby increasing the available time between consecutive collations in the RAT that are generated by different cuts. This guarantees a physical gap between different collations bound for upper and lower accumulation stations 472 and 473 with respective ramps located at sensors 22 and 21, in the accumulator module 407 (these two stations are shown as if in a side view instead of a top view). Upon exiting the accumulation stations, the sheets are propelled at a dump roller nip line 425 and subsequent divert nip line 426.

Newer FIMs are substantially the same as the older FIMs. However, the exact same functionality of a split FIM is not desired in the newer models, as less overlapping is required for separating cut sheet pairs at the high speed nip line 424 that may belong to different collations. The older FIM consisted of flat belts and nips and resided in its own cabinet. The newer FIM consists of two nips, positioned side by side to handle 2-up-format, and may physically reside in the RAT module. These nips are driven by a common servo motor. As mentioned, the paper path dimension between the blade cut line 420 and the FIM nip line 421 is adjustable to be slightly larger than the length of the cut sheet document length (L). The amount that the dimension is greater than L is dependent primarily upon the overshoot of the cutter tractor profile when the advancing web comes to rest.

Equations have been derived, as a function of the cut sheet dimensions, to determine the constant velocities required for the FIM, RAT, HSN and accumulator for both a 25K and a 36K cutter that minimize the required HSN and accumulator velocities. There exists a practical design velocity limit on the accumulator of approximately 300 inches per second, before sheet damage occurs during accumulation upon lead edge impact with the dump roller.

Based on modeling the motion profiles of a 36K cutter, the peak velocity of a paper advance motion profile becomes excessive and can exceed 300 inches/s, depending on the velocity profile shape of the advancing mechanism. It is this high peak velocity that causes an impending cut sheet that is advancing to effectively close the displacement gap between it and a previously cut sheet that is under control of the FIM nip.

Generally, for most cut sheet application dimensions, the required take-away velocity of the FIM is calculated to be less than the calculated velocity of the RAT. For these cases the take-away FIM nips operate at constant velocity. The calculated minimum velocity of this nip is the velocity such that the lead edge of the upstream advancing web never runs into the trail edge of the sheets exiting the cutter (a.k.a. tip-to-tail crash) during full speed cutter operation.

However, there exist customer applications that use cut sheets that are within specification but have a relatively high aspect ratio (length/width). For these cases the take-away velocity must be greater than the calculated RAT velocity that minimizes the HSN and accumulation velocities. It is for these conditions that some solution is necessary in order to maintain high throughput performance. Without such a solution, subsequent downstream velocities would need to be increased, thereby driving the velocity of the accumulator above 300 inches per second, which is a velocity threshold where the accumulator no longer can accumulate reliably without damaging the sheets.

For processing cut sheets that have a relatively high aspect ratio (length/width), the FIM nip (i.e. the take-away nip of the feeder interface module) does not operate at constant velocity. After accepting the lead edge of a sheet at a high velocity, the FIM nip will decelerate to a lower velocity that matches that of the downstream RAT, thereby preventing a tip to tail crash. Once the trail edge of the sheet exits the FIM take-away nip, the nip accelerates back up to the required high take-away velocity before the arrival of the next cut sheet.

For processing sheets with a 36K cutter, this entire motion sequence repeats every 100 ms. The following variables are defined and are used in the equations to follow:

$ACCEL_{FIM}$=acceleration of the first nip of FIM $DECEL_{FIM}$=deceleration of the first nip of FIM $L_{DOC}$=document length $W_{DOC}$=document width $L_{BLADERAT}$=distance from the first FIM nip to the first RAT nip $L_{NIP}$=distance from the first FIM nip to the first RAT nip $L_{SENSOR}$=distance between center line of FIM nip and sensors 11 and 10

Figure 5:
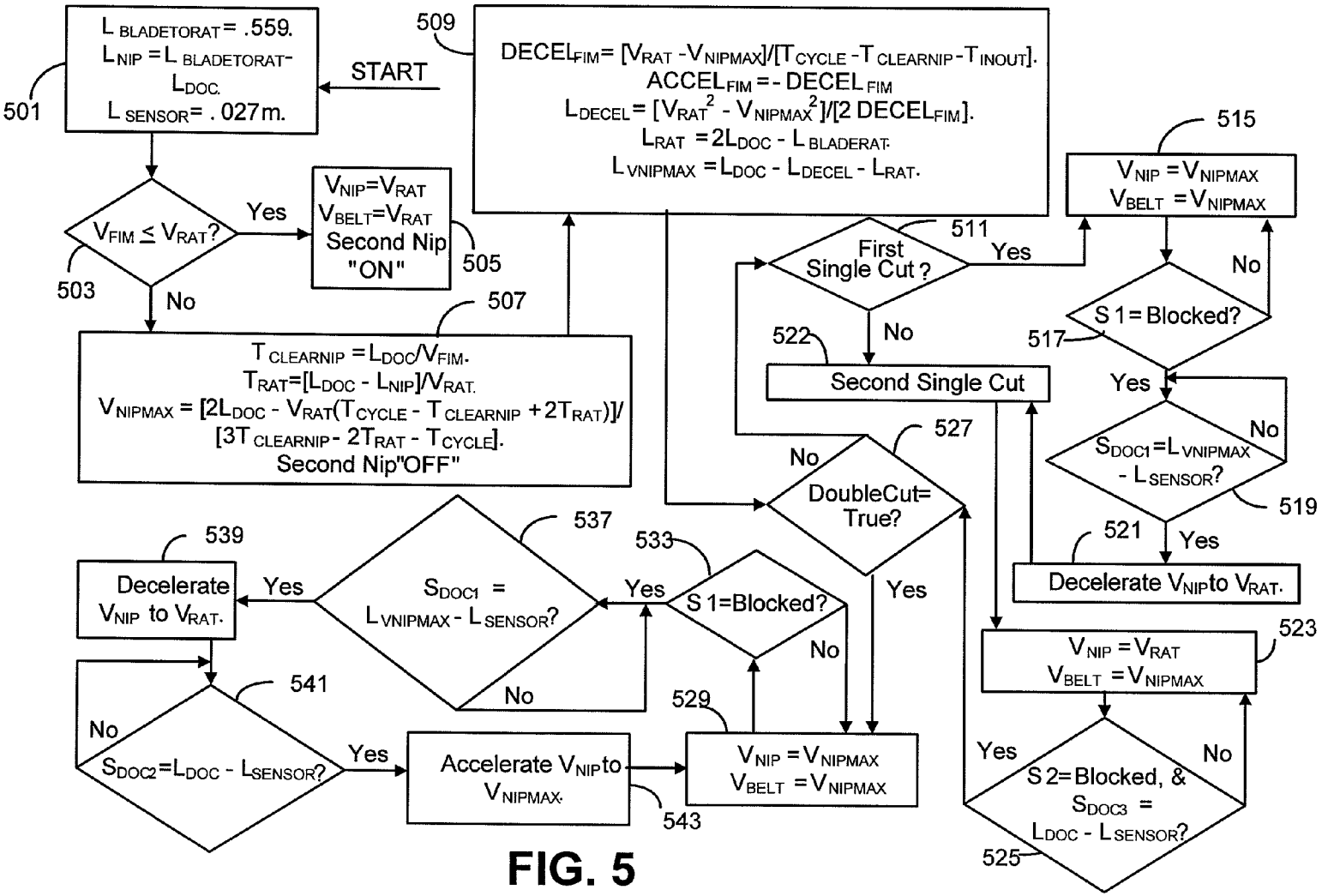
FIG. 5 is a flow chart of the logic used to determine if an FIM motion profile is to be used.

$L_{DECEL}$=distance document travels during deceleration $L_{RAT}$=distance document travels with $V_{RAT}$ velocity $L_{VNIPMAX}$=distance document travels with velocity $V_{NIPMAX}$ $S_{DOC1}$=distance from sensor 11 light extinction (LE) to start accel $S_{DOC2}$=distance from sensor 11 light extinction (LE) to start accel $S_{DOC3}$=distance from sensor 10 light extinction (LE) to start accel $T_{CYCLE}$=cycle time between paper cuts $T_{CLEARNIP}$=time document is in contact with first nip of the FIM $T_{RAT}$=time required for document to travel with velocity $V_{RAT}$ $T_{INOUT}$=time between inner and out sheets are cut $V_{NIPMAX}$=max velocity of the first nip of the FIM $V_{RAT}$=velocity of the RAT nip $V_{FIM}$=required average FIM speed to avoid tip to tail crash $V_{NIP}$=current velocity of the first nip of the FIM $V_{BELT}$=linear velocity of the belts These variables appear in FIG. 5, which is a flow chart of the logic used to determine whether a FIM motion profile is to be used, while describing several equations that may define the parameters of that motion profile, according to the present embodiment of the invention. FIG. 5 also illustrates the control that the FIM nips depend upon if a double cut as opposed to a single cut has been performed at the cutter for sheet(s) entering the FIM module.

Figure 8:
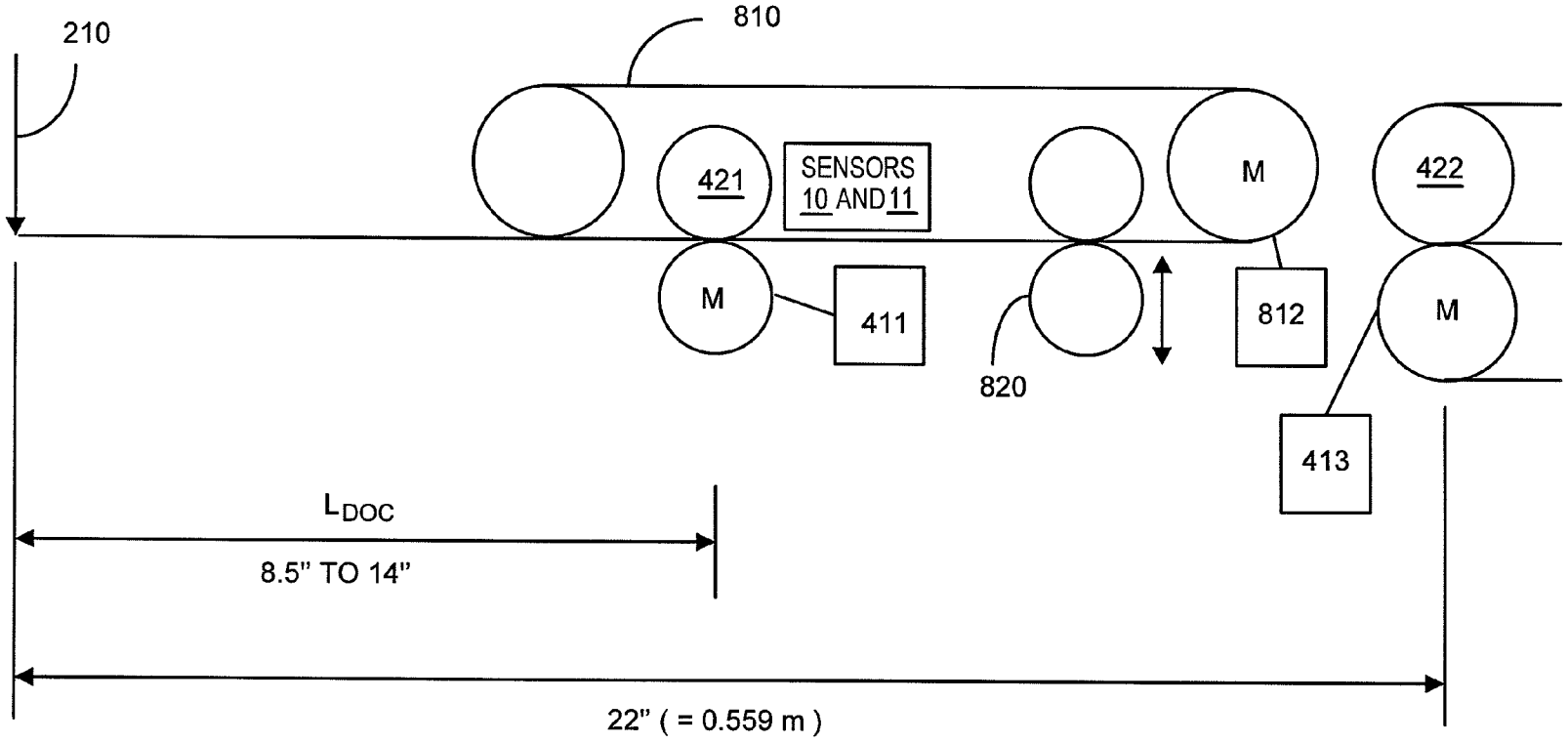
FIG. 8 illustrates structure of the FIM module.

Starting at step 501, physical distances $L_{BLADETORAT}$=0.559 m, $L_{SENSOR}$=0.027 m are given and $L_{NIP}$ is computed. $L_{SENSOR}$ is a constant for all cut sheet lengths, $L_{DOC}$, and therefore the sensors 10 (S2) and 11 (S1) travel as an integral assembly with the adjustable FIM nips. At step 503, the control system determines if the calculated velocity, $V_{FIM}$, required to avoid a tip to tail crash at the exit of the cutter is less than or equal to calculated velocity, $V_{RAT}$, required to minimize downstream transport velocities while still providing successful sheet separation at the High Speed Nip for subsequent high speed sheet accumulation. If this is true 505, no changing FIM nip motion profile is required and $V_{NIP}=V_{BELT}=V_{RAT}$ and the retractable second nips are "ON" or engaged as shown in FIG. 8. In practice, this condition has been found to be the case for all documents that are less than, but not equal to, 11 inches long ($L_{DOC}$).

If step 503 is false, a changing FIM nip motion profile is required for successful material handling downstream of the Cutter if it is desired to not degrade the Cutter's cut rate performance, which is the entire objective of the invention. At step 507, $V_{NIPMAX}$ is computed and the second nip should be "OFF" or disengaged by setting it in the down position. FIG. 8 shows this second nip in the "ON" or engaged position.

Figure 6:
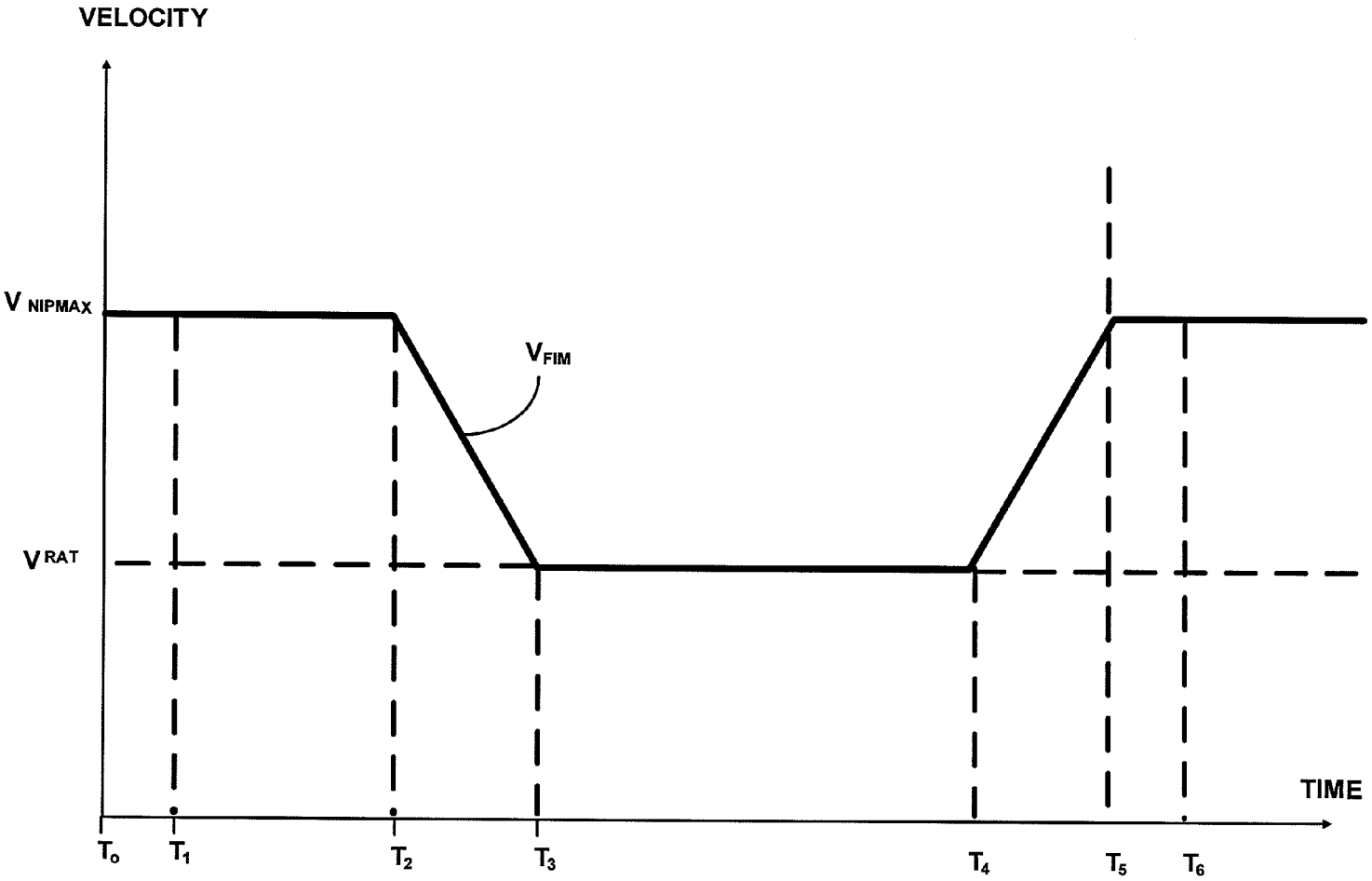
FIG. 6 illustrates a typical motion profile for the FIM nip utilizing the invention.

FIG. 6 shows a typical motion profile for the FIM nip, according to this embodiment of the present invention. Of course, variables appearing in FIG. 6 also appear in FIG. 5. The velocity (i.e. tangential speed) of the FIM nip is shown by the dark line $V_{FIM}$. $V_{NIPMAX}$ is the velocity of the FIM nip when the lead edge of sheets that have just been cut are ingested into them to ensure rapid take-away from the cutter blade, thereby avoiding a tip-to-tail crash on the next web advance motion cycle of the cutter.

As shown in FIG. 6, at time $T_o$, the lead edge of paper reaches the FIM nip (also sometimes called a control nip). At time $T_1$, the lead edge reaches sensor 10 and/or 11. At time $T_2$, the deceleration of the FIM nip begins. At time $T_3$, the deceleration stops. At time $T_4=T_{CLEARNIP}$, the trail edge of the paper exits the FIM nip. At time $T_5=T_{CYCLE}$ marks the end of a velocity cycle for the FIM nip, and the duration $T_5$-$T_o$ is less than the time between paper cuts. At time $T_6$, the lead edge of the next sheet of paper enters the FIM nip.

In FIG. 6, the difference $T_1$-$T_o$ times the velocity $V_{NIPMAX}$ gives the distance $L_{SENSOR}$ between the center line of the FIM nip and sensors 10 and 11. The difference $T_2$-$T_1$ times the velocity $V_{NIPMAX}$ gives the distance $S_{DOC1}$ from sensor 11 light extinction (LE) to start decel. The distance $L_{SENSOR}$ plus $S_{DOC1}$ is the distance ($L_{VNIPMAX}$) that the document travels with velocity $V_{NIPMAX}$ between $T_o$ and $T_2$. The integral of $V_{FIM}$ from $T_2$ to $T_3$ is the distance ($L_{DECEL}$) that the document travels during deceleration. The difference $T_4$-$T_3$ times the velocity $V_{RAT}$ gives the distance $L_{RAT}$ that the document travels with velocity $V_{RAT}$. The sum of $L_{VNIPMAX}$ and $L_{DECEL}$ and $L_{RAT}$ is the distance $S_{DOC2}$ from sensor 11 light extinction (LE) to start accel. The distance $S_{DOC2}$ plus the distance $L_{SENSOR}$ is the document length $L_{DOC}$.

Referring now to FIG. 5 again, step 509 computes when the FIM nip begins to decelerate at displacement, $S_{DOC1}$, from the sensor lead edge (LE) event. Note that $L_{NIPMAX}=L_{SENSOR}$ $S_{DOC1}$. Since both sensors are located downstream of the FIM nip and actually travel with the FIM nips as an assembly when adjusting the location of the FIM nip for cut sheet length, $L_{DOC}$, the cut sheets are always in positive control of the FIM nips when the lead edges are detected by the sensors.

Step 509 also computes the deceleration of the FIM nips, $DECEL_{FIM}$, to reduce the velocity of these nips to the velocity of the RAT module, $V_{RAT}$, before the lead edge of the cut sheet(s) reach the RAT nip(s). It is critical for reliable paper handling that control nips have matched velocities while transferring cut sheets between the control nips.

Next in FIG. 5, the control system determines whether or not to double cut the 2-up web at step 527. A double cut is executed if downstream conditions allow, thereby having the cutter cut 2 side-by-side sheets with a single guillotine blade motion. In the case of a non-double cut, a first single cut cuts only one sheet that is located on the paper path side that travels the shorter inner path through the RAT module. A second single cut cuts the remaining sheet that travels the longer outer path through the RAT module.

If the decision to double cut is true, then the velocity of the both the FIM nip and the urge belts are set to calculated value, $V_{NIPMAX}$ 529. After the cut takes place, the lead edge of the inner cut sheet travels downstream and eventually reaches sensor 11 which becomes blocked at step 533. When this occurs, the control system continues to transport both cut sheets by displacement, $S_{DOC1}$, where upon the deceleration of the FIM nip commences, as illustrated in FIG. 6. Once the sheets and the nip reach velocity, $V_{RAT}$, the control system conveys the sheets at constant velocity for displacement $L_{RAT}$ at step 541, also shown in FIG. 6. During this time, the trail edge of the sheets must exit the FIM nips. Once displacement, $L_{RAT}$, is accomplished, the FIM nips and cut sheets will accelerate back up to $V_{NIPMAX}$ in preparation to accept the next cut sheet(s) to be released by the cutter. For the invention to be successful, the FIM nips must return back to original velocity, $V_{NIPMAX}$, in less than one cutter cycle period, or time, $T_{CYCLE}$. For high speed Cutter operation processing sheet length, $L_{DOC}$, equal to 12 inches, this period is on the order of 100 milliseconds.

If at step 527 the control system determines that a double cut cannot be executed due to downstream conditions, then the control system determines if a single cut can execute at step 511. If this is true, $V_{NIP}$ and $V_{BELT}$ are set to $V_{NIPMAX}$. Using similar logic as used for the double cut, after sensor 11, becomes blocked and displacement, $S_{DOC1}$, is achieved, the FIM nips decelerate to velocity, $V_{RAT}$, at step 521.

Once the second single cut occurs at step 522, the velocities at step 523 for the FIM nips and the urge belts are preserved. After the second single cut sheet is released from the Cutter, the lead edge of the outer cut sheet travels downstream and eventually reaches sensor 10, which becomes blocked at step 525. When this occurs, the control system continues to transport the cut sheet by displacement $S_{DOC3}$, where upon the control system determines if the downstream conditions will accept a double cut at 527.

Figure 7:
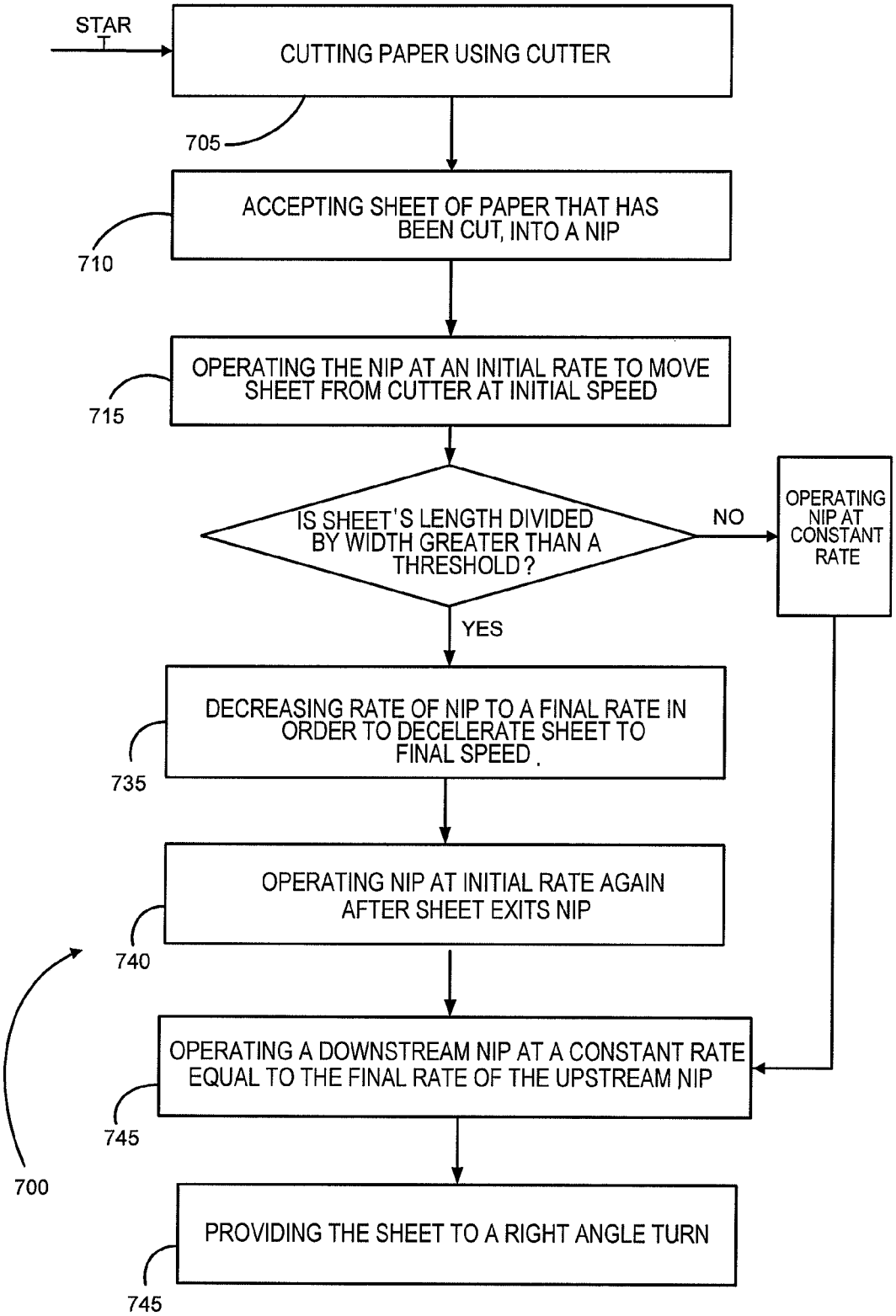
FIG. 7 is a flow chart illustrating a simplified method according to an embodiment of the invention.

FIG. 7 illustrates a simplified method 700 according to an embodiment of the invention. Paper is cut 705 using a paper cutter. Then, the sheet is accepted 710 into a nip, such as the FIM nip shown in FIG. 4. The nip is operated 715 at an initial rate to move the sheet from the cutter at an initial speed. If the sheet's length divided by its width is less than a threshold value, the nip is operated at a constant rate. However, if that ratio is greater than a threshold value, then the nip rate decreases 735, until the sheet exits the nip at which time the nip returns 740 to its initial rate.

In any event, whether the threshold is exceeded or not, a downstream nip will be operated at a uniform rate 745 equal to the final rate of the upstream nip. The downstream nip provides 745 the sheet to a right angle turn (RAT).

FIG. 8 shows more details of the geometry of the FIM module 403, according to this embodiment of the invention, illustrating the geometry of the FIM nips in relation to the upstream cutter module and the downstream RAT module. The cutter blade 210 executes multiple cuts per second. The FIM nips 421 have an adjustable distance from the cutter blade (allowing for different sizes of paper). A motor connected to SMC 411 drives the FIM nips. Another motor is connected to SMC 812 for driving the urge belts 810. Optionally, second nips 820 can be used, and these second nips 820 are preferably retractable, so that they can be retracted depending upon the size of paper sheets that are being cut. A further one of the motors is for SMC 413 that drives the RAT entrance nips 422. The fixed urge belts 810 provide non-positive drive to cut sheets which assist with the conveyance of transporting the lead edge of cut sheets reliably to the RAT entrance nips 422 during times when FIM nips 421 are primarily pushing on the trail edge of cut sheets (i.e. "pushing a rope"). Retractable second nips 820 can be driven by the urge belts 810. Additional urge devices (not shown) can be used, in order to drive the paper from the cutter into the FIM nips 421. The second nips provide positive drive for short documents, where the distance between the FIM nips and the RAT entrance nips is greater than $L_{DOC}$. Sensors 11 and 10 exist just downstream of the FIM nips 421, where for a 2-up web sensor 11 is the sensor on the paper path side where sheets travel an inner shorter path through the RAT module. Sensor 10 is the sensor on the paper path side where sheets travel a longer outer path through the RAT module.

The embodiment described above can be implemented using a general purpose or specific-use computer system, with standard operating system software conforming to the method described herein. The software is designed to drive the operation of the particular hardware of the system, including the various servo motors, and will be compatible with other system components and I/O controllers. The computer system of this embodiment includes a CPU processor, comprising a single processing unit, multiple processing units capable of parallel operation, or the CPU can be distributed across one or more processing units in one or more locations, e.g., on a client and server. The computer system will advantageously also include a memory unit that includes any known type of data storage and/or transmission media, including magnetic media, optical media, random access memory (RAM), read-only memory (ROM), a data cache, a data object, etc. Moreover, similar to the CPU, the memory may reside at a single physical location, comprising one or more types of data storage, or be distributed across a plurality of physical systems in various forms.

It is to be understood that all of the present figures, and the accompanying narrative discussions of preferred embodiments, do not purport to be completely rigorous treatments of the methods and systems under consideration. A person skilled in the art will understand that the steps of the present application represent general cause-and-effect relationships that do not exclude intermediate interactions of various types, and will further understand that the various structures and mechanisms described in this application can be implemented by a variety of different combinations of hardware and software, and in various configurations which need not be further elaborated herein.

What is claimed is:

1. A method for accelerating and decelerating sheets of paper in a paper-cutting system, the method comprising:

cutting a web of paper using a cutter, when the paper is substantially stopped, to form a sheet of paper having dimensions exceeding at least one threshold, the sheet comprising a leading end and a tail end;

securing the leading end of the sheet of paper in a nip;

operating the nip to move the sheet of paper away from the cutter;

decelerating the nip based on the threshold in order to slow the sheet of paper to a final speed at least by the time the tail end of the sheet of paper exits the nip;

repeating operation of the nip in order to move further sheets of paper away from the cutter;

wherein the final speed of each sheet of paper is suitable for processing the sheet in a downstream processing component;

wherein an average speed of each sheet of paper, while it is secured in the nip, is greater than the final speed; and wherein the average speed is high enough to avoid contact between each sheet of paper and the web, but low enough to prevent the leading end of each sheet of paper from contacting a downstream sheet.

2. The method of claim 1, wherein the at least one threshold is a ratio of sheet length divided by sheet width.

3. The method of claim 2 wherein the final speed depends upon said ratio of sheet length divided by sheet width.

4. The method of claim 1, wherein the downstream processing component comprises a right angle turn device, wherein, when the sheet of paper has the final speed, the nip has a corresponding final rate equal to a substantially constant rate of a downstream nip, and wherein the downstream nip precedes the turn of the right angle turn device.

5. The method of claim 4 wherein the final rate of the nip substantially equals the constant rate of the downstream nip.

6. An apparatus for accelerating and decelerating sheets of paper in a paper-cutting system, the apparatus comprising:

a cutter configured to cut a web of paper when the paper is substantially stopped, in order to form a sheet of paper having dimensions exceeding at least one threshold, the sheet comprising a leading end and a tail end;

a nip configured to secure the leading end of the sheet of paper;

a motor and motor controller configured to operate the nip to move the sheet of paper away from the cutter, and further configured to decelerate the nip based on the threshold in order to slow the sheet of paper to a final speed at least by the time the tail end of the sheet of paper exits the nip, and furthermore configured to repeat operation of the nip in order to move further sheets of paper away from the cutter;

wherein the final speed of each sheet of paper is suitable for processing the sheet in a downstream processing component wherein an average speed of each sheet of paper, while it is secured in the nip, is greater than the final speed, and wherein the average speed is high enough to avoid contact between each sheet of paper and the web, but low enough to prevent the leading end of each sheet of paper from contacting a downstream sheet.

7. The apparatus of claim 6, wherein the at least one threshold is a ratio of sheet length divided by sheet width.

8. The apparatus of claim 7 wherein the final speed depends upon said ratio of sheet length divided by sheet width.

9. The apparatus of claim 6, wherein the downstream processing component comprises a right angle turn device, wherein, when the sheet of paper has the final speed, the nip has a corresponding final rate equal to a substantially constant rate of a downstream nip, and wherein the downstream nip precedes the turn of the right angle turn device.

10. The apparatus of claim 9, wherein the final rate of the nip substantially equals the constant rate of the downstream nip.

* * * * *